US007106146B2

(12) United States Patent
Tsukahara et al.

(10) Patent No.: US 7,106,146 B2
(45) Date of Patent: Sep. 12, 2006

(54) HIGH FREQUENCY SWITCH

(75) Inventors: Yoshihiro Tsukahara, Tokyo (JP); Makio Komaru, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 5 days.

(21) Appl. No.: 10/895,837

(22) Filed: Jul. 22, 2004

(65) Prior Publication Data

US 2005/0093646 A1 May 5, 2005

(30) Foreign Application Priority Data

Oct. 29, 2003 (JP) ..... 2003-369377

(51) Int. Cl.
*H01P 1/15* (2006.01)

(52) U.S. Cl. ..... 333/104; 333/101

(58) Field of Classification Search ..... 33/32; 333/101, 103, 104, 109; 343/853
See application file for complete search history.

(56) References Cited

U.S. PATENT DOCUMENTS 5,375,257 A * 12/1994 Lampen ..... 455/83
5,485,130 A * 1/1996 Nakahara et al. ..... 333/104
6,014,066 A * 1/2000 Harberts et al. ..... 333/104
6,515,635 B1 * 2/2003 Chiang et al. ..... 343/834
6,864,758 B1 * 3/2005 Luen et al. ..... 333/35

FOREIGN PATENT DOCUMENTS

| | | |
|---|---|---|
| JP | 2000-155171 | 6/2000 |
| JP | 2000-261216 | 9/2000 |
| JP | 2000-294568 | 10/2000 |
| JP | 2002-33602 | 1/2002 |
| JP | 3368874 | 11/2002 |
| JP | 3417386 | 4/2003 |

* cited by examiner

*Primary Examiner*—Dean Takaoka
(74) *Attorney, Agent, or Firm*—McDermott Will & Emery LLP

(57) ABSTRACT

A signal line, which branches into four more from a connecting line on the input side via a branch point and has the branch signal lines including λ/4 transmission lines at their parts, and FETs respectively connected in shunt with the branch signal lines between connecting points on the output terminal sides as viewed from the λ/4 transmission lines provided in the branch signal lines and ground ends are provided on a semiconductor substrate. Connecting points of the FETs at the two branch signal lines are disposed with being spaced such a distance that isolation corresponding to the frequency of an RF signal reaches more than equal to 25 dB and less than or equal to 35 dB at the ends of these branch signal lines.

9 Claims, 9 Drawing Sheets

HIGH FREQUENCY SWITCH

BACKGROUND OF THE INVENTION

1. Field of the Invention

The present invention relates to a high frequency switch, and particularly to a high frequency switch used for switching of an RF signal used for a radar and a communication device operated in a millimeter wave band.

2. Description of the Related Art

The application of a microwave device has been increasingly advanced with the progression of computerization. A microwave device of a cellular phone using a relatively low frequency, a microwave device used in information communication by a high frequency much higher than the low frequency of the cellular phone, a microwave device used in communication apparatuses such as a radar for automobile use, an observation satellite, etc. each of which uses a high frequency much higher than the above frequency in information communication, etc. have been applied in many fields.

Of these, the radar using the millimeter wave-band microwave device is used to recognize a forward vehicle or automobile and constitutes part of a system for performing automobile's collision avoidance.

A system for scanning nine directions has been used in a millimeter wave-band radar for detecting a forward automobile to carry out automobile's collision avoidance. This is used assuming that an automobile runs along three lanes. This system needs to perform the scanning of nine directions with a view toward scanning three directions for each lane. Therefore, there is a need to provide a nine-channel switch which switches an RF signal over to the nine directions.

As a high-speed switch, a small-sized and high-speed high frequency switch using a microwave IC (MIC) has been realized in recent years. Further, it is configured as an MMIC (Monolithic Microwave IC) in which connecting lines and switching elements are integrally formed on a semiconductor substrate, thereby enabling further speeding-up and miniaturization of the switch.

When the nine-channel high frequency switch is configured, the most basic configuration is proposed wherein nine SPST (Single Pole Single Throw) switches formed on a GaAs substrate are used. That is, a signal line that branches into nine branch lines from one input terminal via a branch point is formed on a dielectric substrate, and SPST switches are respectively provided in the individual branch lines of the signal line to thereby configure a nine-channel switch.

Alternatively, a nine-channel switch is configured wherein four SP3T (Single Pole 3 Throw) switches formed on a GaAs substrate are provided on a dielectric substrate, an input end of the first SP3T switch is connected to input signal lines on the dielectric substrate, and input terminals of the three other SP3T switches are respectively connected to three output terminals of the first SP3T switch to thereby set nine output ends.

As a known example of a conventional high frequency switch, there has been disclosed a configuration wherein by adopting a switch circuit using a distributed constant FET for SPDT, a less passage loss can be obtained in the case of switch ON and high isolation can be expected in the case of switch OFF (see, for example, Japanese Patent Laid-open No. 2002-33602, paragraph numbers [0013] and [0014] and FIG. 1).

Further, as a known example of another high frequency switch, there has been disclosed a high frequency switch which includes a plurality of tristate switches which are connected in tournament form by strip lines and wherein the lengths of strip lines from branch points of adjacent lines connected to the individual switches to their corresponding switches are so adjusted that real parts of impedance obtained by viewing the turned-off switches from the branch points of the adjacent lines connected to the individual switches become maximum and imaginary parts thereof reach 0, and the lengths thereof from branch points of roots of the adjacent lines connected to the respective branch points to their corresponding branch points are adjusted to integral multiples of a ½ wavelength (see, for example, Japanese Patent Laid-open No. 2000-261218, paragraph number [0006] and FIG. 1).

Furthermore, as a known example of a further high frequency switch, there has been disclosed one wherein when four or more receiving antennas are switched in a holographic radar, single pole 2 throw (SPDT) or single pole 3 throw (SP3T) unit switches, e.g., planar circuit type high frequency switches like an MMIC and an HIC are utilized and combined in the form of a tournament to thereby realize multi-switching (see, for example, Japanese Patent Laid-open No.2000-155171, paragraph number [0005] and FIG. 5).

Still further, as a known example of yet another high frequency switch, there has been disclosed an example wherein one transmission line is provided in the direction of the input of a signal and the remaining two transmission lines are provided in the directions of 90°, 180° and 270° with respect to the input direction of the signal to make equal distances to respective output terminals, thereby forming 3-distributed switches low in loss and equal in loss (see, for example, Japanese Patent Laid-open No. 2000-294568, paragraph number [0031] and FIG. 5).

However, the nine channel switches respectively having such a configuration that the nine SPST switches are used and such a configuration that the four SP3T switches are used, are hard to achieve a size reduction because the dielectric substrates become large. Further, since the characteristics of the respective SPST and SP3T switches to be used are hard to match and the number of parts increases, the electrical characteristics of individual channels are apt to vary due to variations in bonding wire at their packaging. It was also difficult to constitute the high frequency switch having the nine channels uniform in electrical characteristic. It is thus considered that in order to constitute the nine-channel switch uniform in electrical characteristic, the MMIC configured by the one-chip GaAs substrate constitutes switches that branch into nine.

Isolation is considered as one of major parameters indicative of switch performance of a high speed switch. Since, however, the branch lines can be laid out at intervals of 90° with respect to the input signal line in the SP3T switch, it was easy to ensure the isolation between the respective branch lines. However, when the nine-branched switches are constituted by the MMIC simply configured of the one-chip GaAs substrate to configure the high frequency switch having the nine channels uniform in electrical characteristic, the branch angle formed between the respective branch lines becomes an acute angle. Therefore, a problem arose in that isolation between respective terminals for the nine channels was hard to obtain.

SUMMARY OF THE INVENTION

The present invention has been made to solve the foregoing problems. A first object of the present invention is to configure a high frequency switch which is small in size and reduced in the number of parts and which has four or more branch lines and provides an isolation ranging more than or equal to 25 dB and less than or equal to 35 dB between the branch lines.

According to one aspect of the invention, there is provided a high frequency switch comprising: a first semiconductor substrate; a first signal line provided on the first semiconductor substrate and having a first main line, and first branch lines that branch into four or more from the first main line via a first branch point and first transmission lines each having a length of a ¼ wavelength of a signal propagated over the first branch lines, each first transmission line being contained in part of said each first branch line; and first switching elements each of which is shunt-connected between the first branch line on the end side of the first transmission line as viewed from the first branch point of the first signal line, and a ground end and electrically connects or shuts off the first branch line and the ground end in accordance with a control signal; wherein mutual connecting points of the first switching elements at the two first branch lines are provided with being spaced such a distance that isolation corresponding to the frequency of the signal reaches more than or equal to 25 dB and less than or equal to 35 dB at the ends of the adjacent first branch lines.

Accordingly, even when four or more branch lines that branch at the acute angle as viewed from a branch point are provided, a high frequency switch according to the present invention can be configured which has predetermined isolation and which is small in size and reduced in the number of parts.

Hence, the high frequency switch can be provided at low cost.

Other objects and advantages of the invention will become apparent from the detailed description given hereinafter. It should be understood, however, that the detailed description and specific embodiments are given by way of illustration only since various changes and modifications within the scope of the invention will become apparent to those skilled in the art from this detailed description.

BRIEF DESCRIPTION OF THE DRAWINGS

In all figures, the substantially same elements are given the same reference numbers.

DESCRIPTION OF THE PREFERRED EMBODIMENTS

First Embodiment

Figure 1:
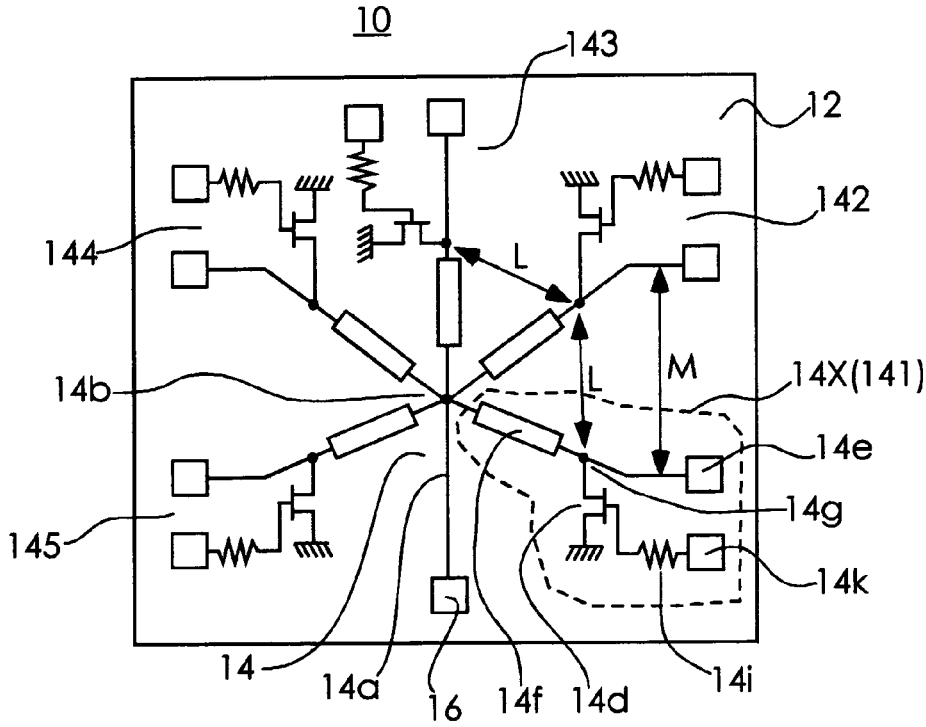
FIG. 1 is a circuit diagram of a high frequency switch according to an embodiment of the present invention.
Figure 2:
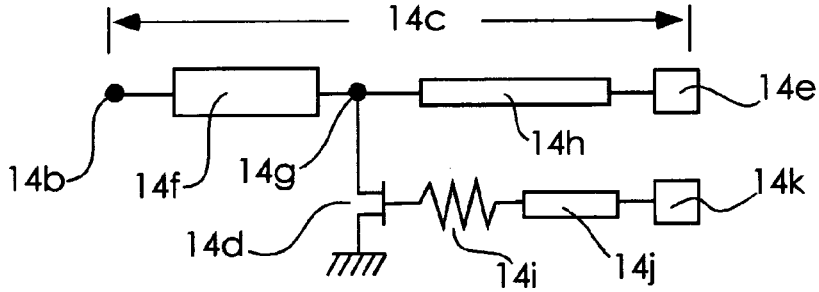
FIG. 2 is a partly circuit diagram illustrating, in further details, a unit switch shown in FIG. 1.

FIG. 1 is a circuit diagram of a high frequency switch according to an embodiment of the present invention. FIG. 2 is a partly circuit diagram illustrating, in further details, a unit switch shown in FIG. 1.

Referring to FIGS. 1 and 2, the high frequency switch 10 is configured as a five branch switch, i.e., an SP5T (Single Pole 5 Throw) switch as one example. The present high frequency switch 10 is an MMIC formed on a GaAs substrate 12 used as a semiconductor substrate. In the high frequency switch 10, an input terminal 16 is provided at an input end of a connecting line 14*a* on the input side, which is used as a main line of a signal line 14 constituted of, for example, a microstrip line, and five branches are made to the connecting line 14*a* of the signal line 14 via a branch point 14*b* so that five unit switches 14X (where X=1, 2, 3, 4 and 5) are arranged. The unit switch 14X includes a branch signal line 14*c* and an FET 14*d* used as a switching element connected in shunt with the branch signal line 14*c*.

Referring to FIG. 2, the branch signal line 14*c* of each unit switch 14X is provided with an output terminal 14*e* at its end. A transmission line 14*f* (hereinafter called "λ/4 transmission line") having a length (i.e., λ/4 length assuming that the wavelength of an RF signal is λ) of a ¼ wavelength of the frequency of the RF signal used in the high frequency switch 10 is provided in close vicinity to the branch point 14*b*. The FET 14*d* is connected in shunt with the branch signal line 14*c* at a connecting point 14*g* on the end side of the λ/4 transmission line 14*f*, i.e., on the output terminal 14*e* side. A connecting line 14*h*, e.g., a microstrip line connects between the connecting point 14*g* and the output terminal 14*e*.

The FET 14*d* is connected between the connecting point 14*g* and a ground end through its source and drain. The gate thereof is provided as a control electrode, and a control terminal 14*k* is provided via a gate resistor 14*i* and a connecting line 14*j* as viewed from the gate electrode.

In the high frequency switch 10, an RF signal is inputted to the input terminal 16 and a control voltage is applied to the control terminal 14*k* connected to the gate electrode of the FET 14*d* of each unit switch 14X so that the unit switch 14X is turned on and off to output the RF signal from the output terminal 14*e*.

That is, when a gate voltage Vg=0V is applied to the control terminal 14*k*, the FET 14*d* is brought to an on state so that the connecting point 14*g* of the FET 14*d* is grounded. Therefore, the connecting point 14*g* is brought to an open end. Thus, the RF signal is reflected by the λ/4 transmission line 14*f* and hence the unit switch 14X is held off.

On the other hand, when a gate voltage Vg less than or equal to a pinch off voltage Vp, e.g., a gate voltage Vg=−5V is applied to the control terminal 14*k*, the FET 14*d* is brought to an off state so that an RF signal is propagated to the output terminal 14*e* via the branch signal line 14*c*.

In order to definitely identify signals among the respective unit switches 14X in the high frequency switch 10, the isolation between the two unit switches 14X is set to 25 dB or more, for example, 30 dB in the present embodiment.

Since it is normally difficult to ensure the isolation between the adjacent respective unit switches 14X, e.g., between 141 and 142 or 144 and 145, the isolation between the respective unit switches 14X is ensured if the isolation between the adjacent unit switches 14X is 25 dB or more. However, the present invention is not necessarily limited to the isolation between the adjacent unit switches 14X. The isolation between the arbitrary two unit switches 14X is also set to 25 dB or more.

This isolation corresponds to isolation measured between the output terminals 14*e* provided at the ends of the two unit switches 14X. The value of the isolation is determined according to the distance (corresponding to an interval indicated by L in FIG. 1) between the connecting points 14*g* at which the FETs 14*d* in the two unit switches 14X are connected to their corresponding branch signal lines 14*c*, or the shortest line-to-line distance (corresponding to an interval indicated by M in FIG. 1) between the connecting lines 14*h* of the branch signal lines 14*c* in the two unit switches 14X.

Figure 3:
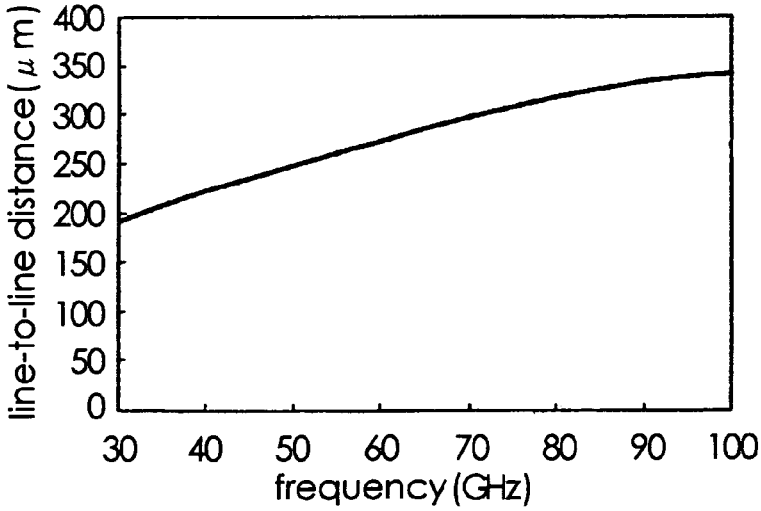
FIG. 3 is a graph showing a line-to-line distance with respect to the frequency for obtaining the isolation of the high frequency switch according to an embodiment of the present invention.

FIG. 3 is a graph showing a line-to-line distance with respect to the frequency for obtaining the isolation of the high frequency switch according to an embodiment of the present invention. FIG. 3 shows a result of calculation of a necessary line-to-line distance with respect to the frequency of an RF signal where the isolation is 30 dB when a dielectric constant of the GaAs substrate 12 is set as 12.9.

In FIG. 3, the line-to-line distance corresponds to a distance L between the connecting points 14*g* at which the FETs 14*d* are connected to their corresponding branch signal lines 14*c* in the two unit switches 14X. Alternatively, it corresponds to the shortest line-to-line distance M between the connecting lines 14*h* of the branch signal lines 14*c* in the two unit switches 14X.

If an attempt is made to use the high frequency switch 10 as, for example, a 77 GHz-band switch and ensure an isolation of 30 dB, then 310 μm is needed as the line-to-line distance. In the case of a 60 GHz-band switch, the line-to-line distance needs 270 μm. When a 90 GHz-band switch is used, the line-to-line distance needs 330 μm.

In the sight of the isolation, the longer the distance L between the connecting points 14*g* and the line-to-line distance M between the connecting lines 14*h*, the better. As, however, the distance L between the connecting points 14*g* and the line-to-line distance M between the connecting lines 14*h* increase, the size of the GaAs substrate 12 becomes large and hence the MMIC becomes large in chip size.

Further, since the loss increases and a power loss becomes great with the increase in the chip size, large power is needed. The magnitude of isolation necessary and enough for it exists. If its magnitude ranges more than or equal to 25 dB and less than or equal to 35 dB, more preferably, it falls within a value ranging more than or equal to 29 dB and less than or equal to 31 dB, for example, then the signals among the unit switches 14X can be definitely identified. That is, sufficient resolution is obtained and a high frequency switch whose substrate is small and power loss is less reduced, can be configured.

That is, in the high frequency switch 10, the distance L between the connecting points 14*g* and the line-to-line distance M between the connecting lines 14*h* are set in such a manner that the isolation measured between the output terminals of the two unit switches 14X falls within a range more than or equal to 25 dB and less than or equal to 35 dB, more desirably, a value more than or equal to 29 dB and less than or equal to 31 dB.

Although the unit switch 14X shown in FIGS. 1 and 2 is provided with the FET 14*d* used as the switching element, a diode may be used as an alternative to the FET 14*d*.

Figure 4:
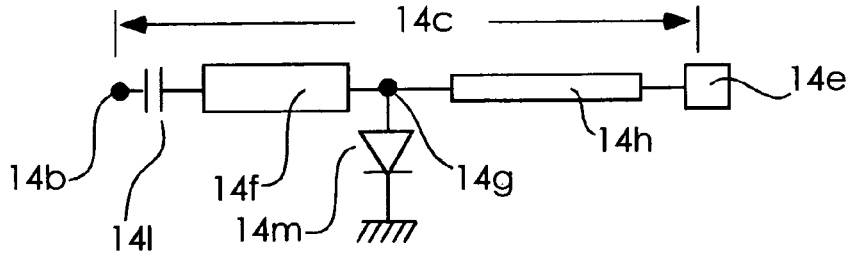
FIG. 4 is a partly circuit diagram where the diode is used in the unit switch shown in FIG. 1.

FIG. 4 is a partly circuit diagram where the diode is used in the unit switch shown in FIG. 1.

In the unit switch 14X shown in FIG. 4, a capacitor 141 is firstly provided in close vicinity to the branch point 14*b* in each branch signal line 14*c*. The λ/4 transmission line 14*f* is provided following the capacitor 141. The diode 14*m* is provided between the connecting point 14*g* on the output terminal 14*e* side, of the λ/4 transmission line 14*f* and the ground end so as to assume the forward direction toward the ground end. Further, the connecting line 14*h*, e.g., the microstrip line connects between the connecting point 14*g* and the output terminal 14*e* which shares the use of the control terminal.

When a forward bias voltage is applied to the output terminal 14*e*, the diode 14*m* is brought into conduction so that the connecting point 14*g* is grounded so as to assume an open end. Thus, the RF signal is reflected by the λ/4 transmission line 14*f* so that the unit switch 14X is brought to an off state.

When a reverse bias voltage is applied to the output terminal, the diode 14*m* is brought into non-conduction. Thus, the diode 14*m* is brought to an off state so that the RF signal is propagated to the output terminal 14*e* via the branch signal line 14*c*.

As described above, the high frequency switch 10 according to the first embodiment includes the signal line 14, which is provided on the semiconductor substrate 12 and which branches into four or more from the connecting line 14*a* on the input side via the branch point 14*b* and has the λ/4 transmission lines 14*f* contained in parts of their branch signal lines 14*c*, and the FETs 14*d* each connected in shunt with the branch signal line 14*c* between the connecting point 14*g* on the output terminal 14*e* side as viewed from the λ/4 transmission line 14*f* provided in the branch signal line 14*c*, and the ground end. The mutual connecting points of the FETs 14*d* or the connecting lines 14*h* in the two branch signal lines 14*c* are arranged with being spaced therebetween such a distance that the isolation corresponding to the RF signal reaches over 25 dB and under 35 dB at the ends of these branch signal lines 14*c*. Owing to such a configuration, necessary isolation between the respective unit units 14X of the high frequency switch 10 can be ensured. It is also possible to bring the semiconductor substrate 12 into less size and cost and reduce a power loss. Further, the high frequency switch 10 is configured as the MMIC and variations in the characteristic between the unit switches 14X can be less reduced. By extension, a high frequency switch, which is uniform in electrical characteristic and which is small in size and low in loss, can be configured. The high frequency switch can be provided at low cost.

Modification 1

Figure 5:
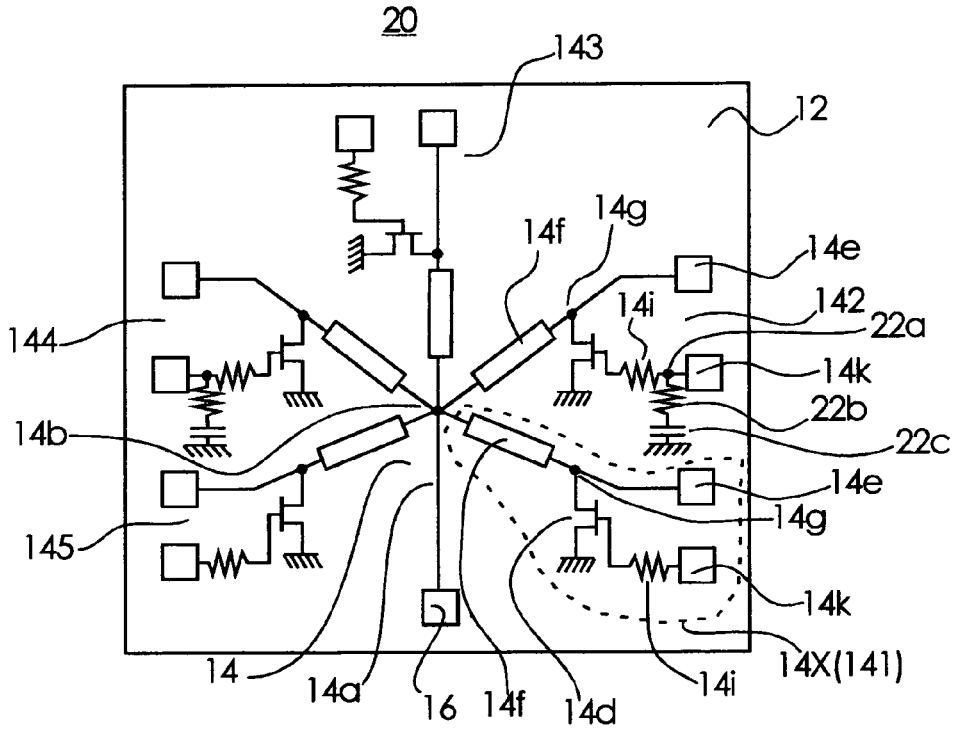
FIG. 5 is a circuit diagram showing a modification of the high frequency switch according to an embodiment of the present invention.
Figure 6:
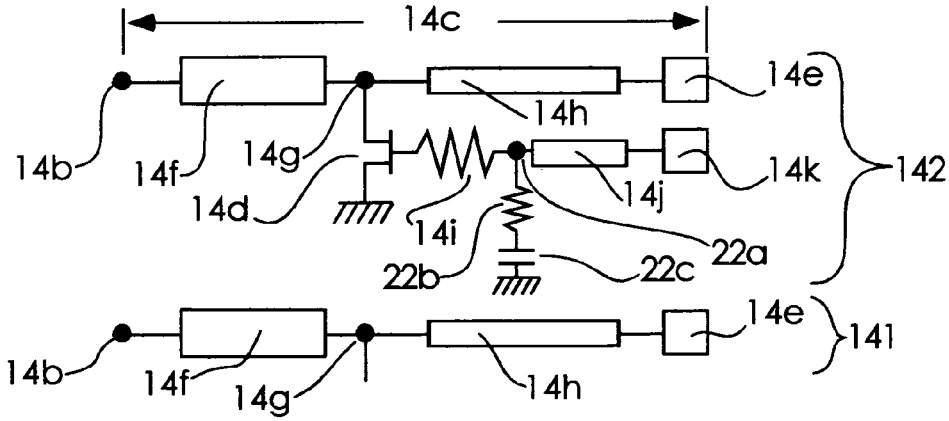
FIG. 6 is a partly circuit diagram showing, in further details, a unit switch shown in FIG. 5.

FIG. 5 is a circuit diagram showing a modification of the high frequency switch according to an embodiment of the present invention. FIG. 6 is a partly circuit diagram showing, in further details, a unit switch shown in FIG. 5. In FIGS. 5 and 6 and the following drawings, the same reference numerals as those shown in FIGS. 1 and 2 indicate the same ones or ones equivalent to them respectively.

In the high frequency switch 10 shown in FIG. 1, the unit switch 141 and the unit switch 142 or the unit switch 144 and the unit switch 145 are both arranged in such a manner that their corresponding connecting lines 14*h* and output terminals 14*e* are directly adjacent to one another through the line-to-line distances M without any intervening object on the substrate.

On the other hand, in the high frequency switch 20 shown in FIGS. 5 and 6, a unit switch 141 and a unit switch 142 or a unit switch 144 and a unit switch 145 are both configured in such a manner that an FET 14*d* connected in shunt with a branch signal line 14*c* of the unit switch 142 or the unit switch 144, a gate resistor 14*i*, a connecting line 14*j* and a control terminal 14*k* are provided between their corresponding connecting lines 14*h* and output terminals 14*e*.

Further, a resistor 22*b* and a capacitor 22*c* for blocking a DC component are connected in series between a connecting point 22*a* provided between these gate resistor 14*i* and connecting line 14*j* and a ground end.

In microwave devices, since the layout of circuit elements influences the electric characteristics of a microwave device, the layout of the high frequency switch 20 might preferably be rather than the layout of the high frequency switch 10 as the case may be. When the resistors 22*b* and the capacitors 22*c* are not respectively provided between the connecting points 22*a* and the ground ends in the layout of the high frequency switch 20, the connecting lines 14*j* and the control terminals 14*k* are interposed in the unit switch 141 and the unit switch 142 or the unit switch 144 and the unit switch 145. Thus, the line-to-line distance M between the adjacent connecting lines 14*h* becomes equivalent to be short, and isolation is degraded depending on load impedance externally connected to each of the control terminals 14*k*.

Therefore, a resistor 22*b* of 50 Ω or more and a capacitor 22*c* for blocking a DC component are connected in series between the connecting point 22*a* and the ground end to thereby enable prevention of degradation of isolation due to a variation in load.

Figure 7:
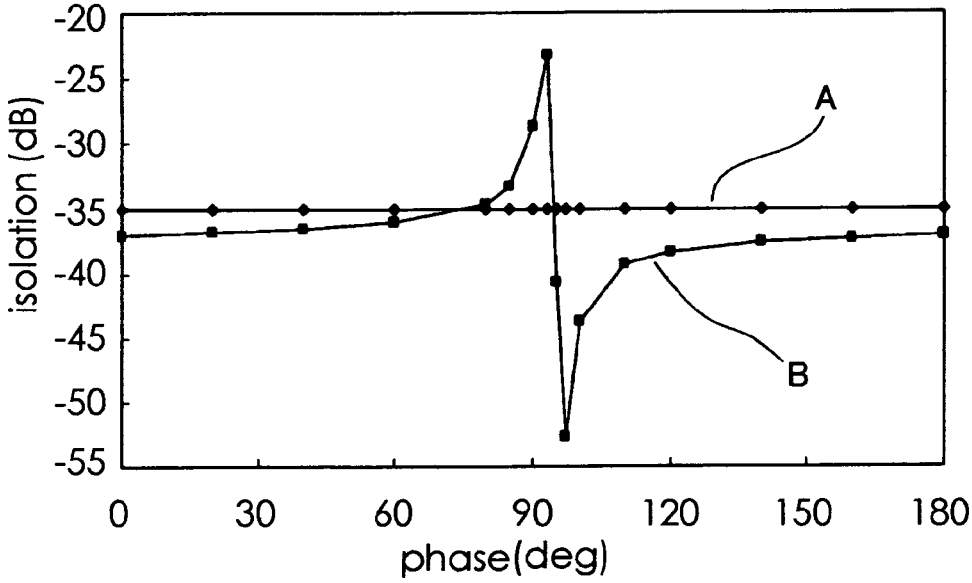
FIG. 7 is a graph showing calculated values of isolations of the high frequency switch according to an embodiment of the present invention.

FIG. 7 is a graph showing calculated values of isolations of the high frequency switch according to an embodiment of the present invention.

Referring to FIG. 7, a diagrammatic drawing A shows one example illustrative of isolations of the high frequency switch 10 and the high frequency switch 20. A diagrammatic drawing B described for comparison shows a case in which no resistors 22*b* and capacitors 22*c* are respectively provided between the connecting points 22*a* and the ground ends in the layout of the high frequency switch 20.

Judging from the graphs, an isolation of 35 dB is ensured in the high frequency switch 10 and the high frequency switch 20.

Although each of the high frequency switch 10 and the high frequency switch 20 is not placed under the influence of a variation in external load, the isolation is greatly degraded due to the external load where no resistors 22*b* and capacitors 22*c* are connected.

Modification 2

Figure 8:
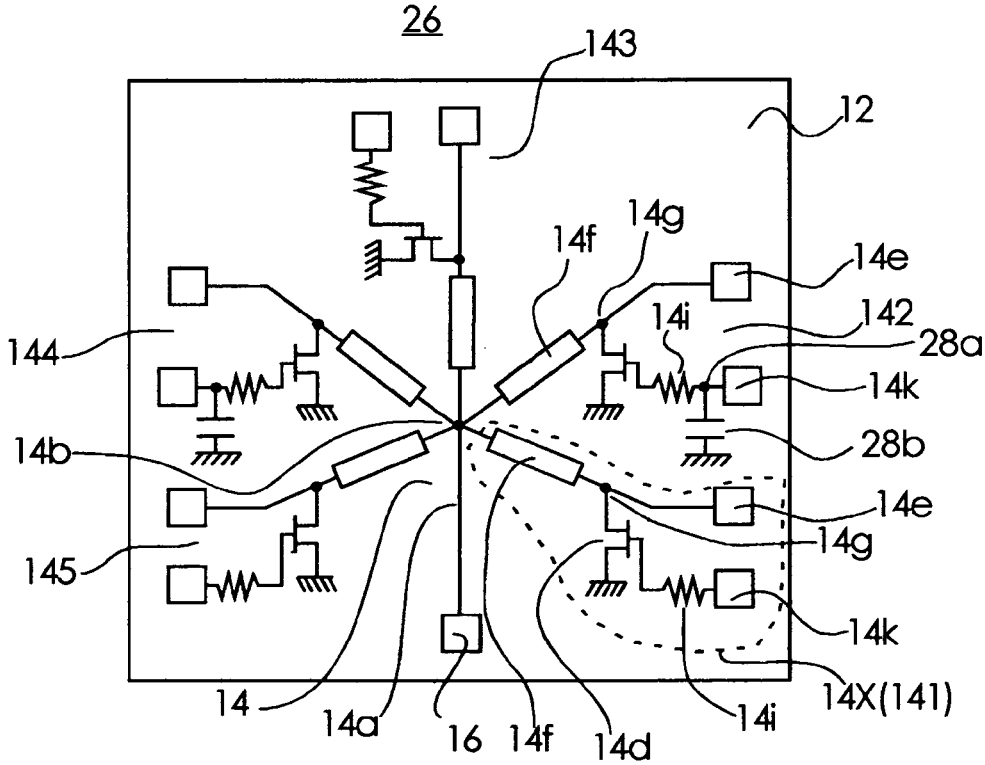
FIG. 8 is a circuit diagram showing a modification of the high frequency switch according to an embodiment of the present invention.
Figure 9:
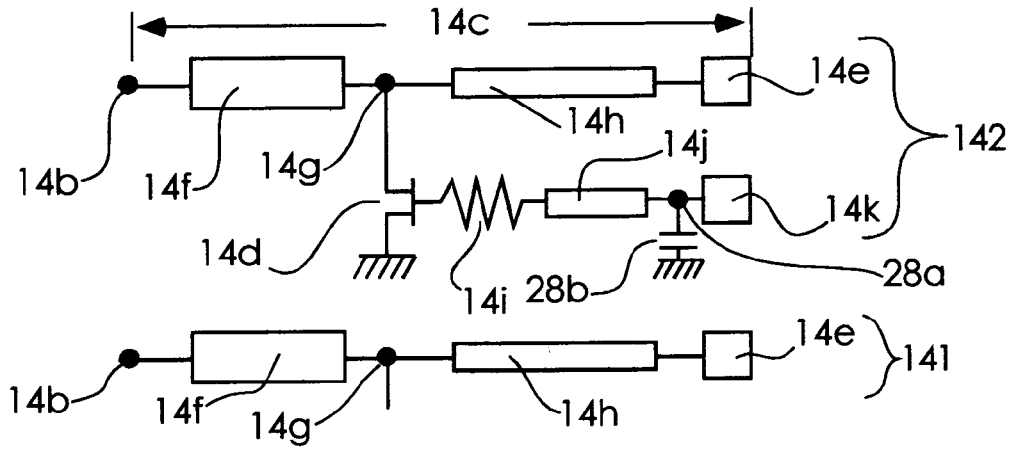
FIG. 9 is a partly circuit diagram showing, in further details, a unit switch shown in FIG. 8.

FIG. 8 is a circuit diagram showing a modification of the high frequency switch according to an embodiment of the present invention. FIG. 9 is a partly circuit diagram showing, in further details, a unit switch shown in FIG. 8.

In the high frequency switch 20 according to the modification 1, the resistor 22*b* of 50 Ω or more and the capacitor 22*c* for blocking the DC component are connected in series between the connecting point 22*a* and the ground end to thereby prevent degradation of the isolation due to the variation in load. In the high frequency switch 26 shown in FIGS. 8 and 9, however, a unit switch 141 and a unit switch 142 or a unit switch 144 and a unit switch 145 are both configured in such a manner that an FET 14*d* connected in shunt with a branch signal line 14*c* of the unit switch 142 or the unit switch 144, a gate resistor 14*i*, a connecting line 14*j* and a control terminal 14*k* are provided between their corresponding connecting lines 14*h* and output terminals 14*e*, and the connecting line 14*j* is set to a length exceeding λ/4 of an RF signal and a capacitor 28*b* for blocking a DC component is provided between a connecting point 28*a* placed between the connecting line 14*j* and the control terminal 14*k* and a ground end, as an alternative to the series-connection of the resistor 22*b* and the capacitor 22*c* between the connecting point 22*a* and the ground end as in the modification 1. Incidentally, if the length of the connecting line 14*j* is not equal to λ/4, then the length thereof may be either longer or shorter than λ/4.

Even in the case of such a configuration, an effect similar to the high frequency switch 20 according to the modification 1 is obtained, and the degradation of isolation due to a variation in load can be prevented. As the isolation, an isolation of 35 dB similar to the diagrammatic diagram A shown in FIG. 7 is obtained.

Modification 3

Figure 10:
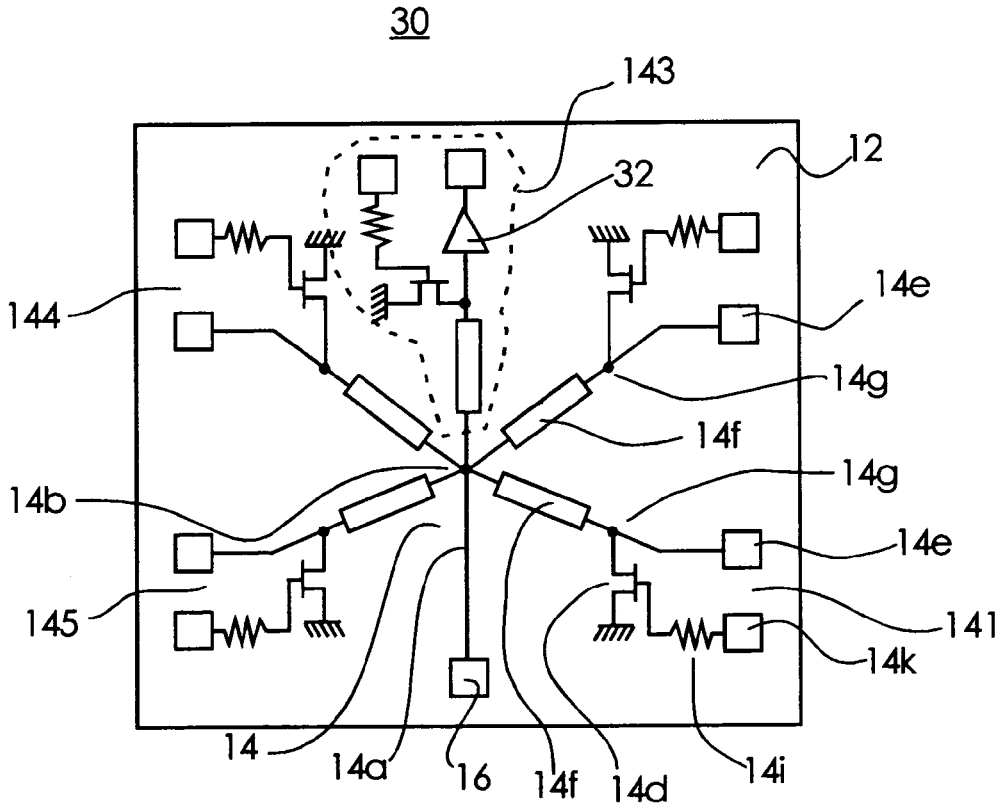
FIG. 10 is a circuit diagram showing a modification of the high frequency switch according to an embodiment of the present invention.

FIG. 10 is a circuit diagram showing a modification of the high frequency switch according to an embodiment of the present invention.

The high frequency switch 30 shown in FIG. 10 is equivalent to one wherein in one of the unit switches 14X (unit switch 143 in FIG. 10) employed in the high frequency switch 10, an amplifier 32 is provided at an end of a branch signal line 14*c* and an output terminal 14*e* is provided through the amplifier 32.

The amplifier 32 is capable of compensating for a passage loss.

Modification 4

Figure 11:
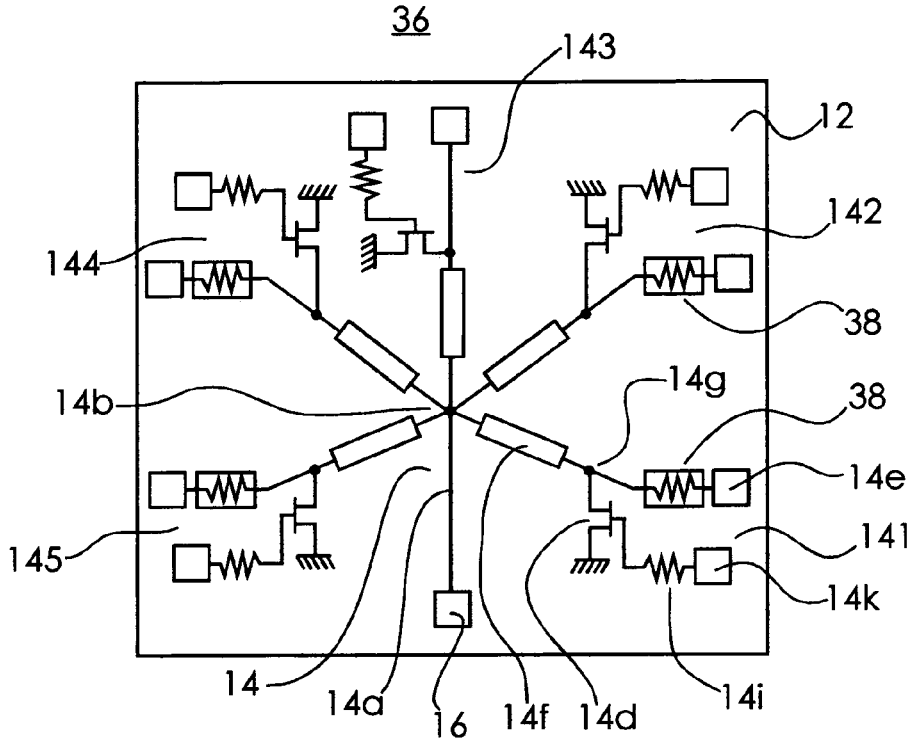
FIG. 11 is a circuit diagram showing a modification of the high frequency switch according to an embodiment of the present invention.

FIG. 11 is a circuit diagram showing a modification of the high frequency switch according to an embodiment of the present invention.

The high frequency switch 36 shown in FIG. 11 is equivalent to one wherein in the unit switches 14X (corresponding to unit switches 141, 142, 144 and 145 in FIG. 11) employed in the high frequency switch 10, attenuators 38 are respectively provided at ends of branch signal lines 14*c* and output terminals 14*e* are respectively provided through the attenuators 38.

Modification 5

Figure 12:
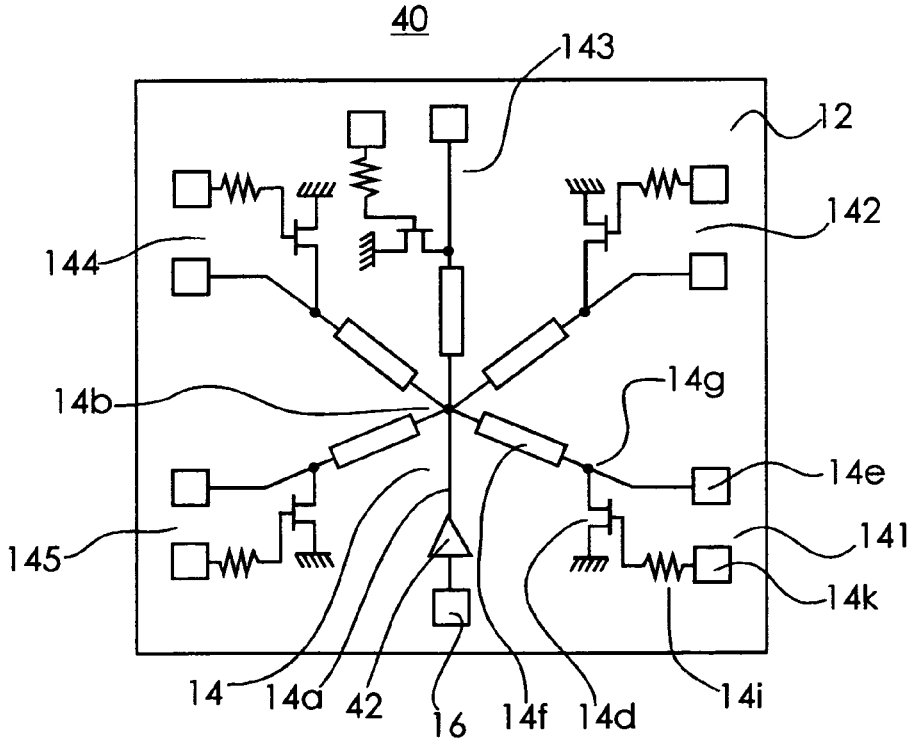
FIG. 12 is a circuit diagram showing a modification of the high frequency switch according to an embodiment of the present invention.

FIG. 12 is a circuit diagram showing a modification of the high frequency switch according to an embodiment of the present invention. The high frequency switch 40 shown in FIG. 12 has a configuration wherein an amplifier 42 is provided following the input terminal 16 of the connecting line 14*a* on the input side in the high frequency switch 10, and an RF signal amplified by the amplifier 42 is transmitted to each unit switch 14X through a branch point 14*b*.

A passage loss occurs during a period in which the signal propagates from the input terminal 16 to an output terminal 14*e* of each unit switch 14X. The amplifier 42 is capable of compensating for the passage loss in advance.

Second Embodiment

Figure 13:
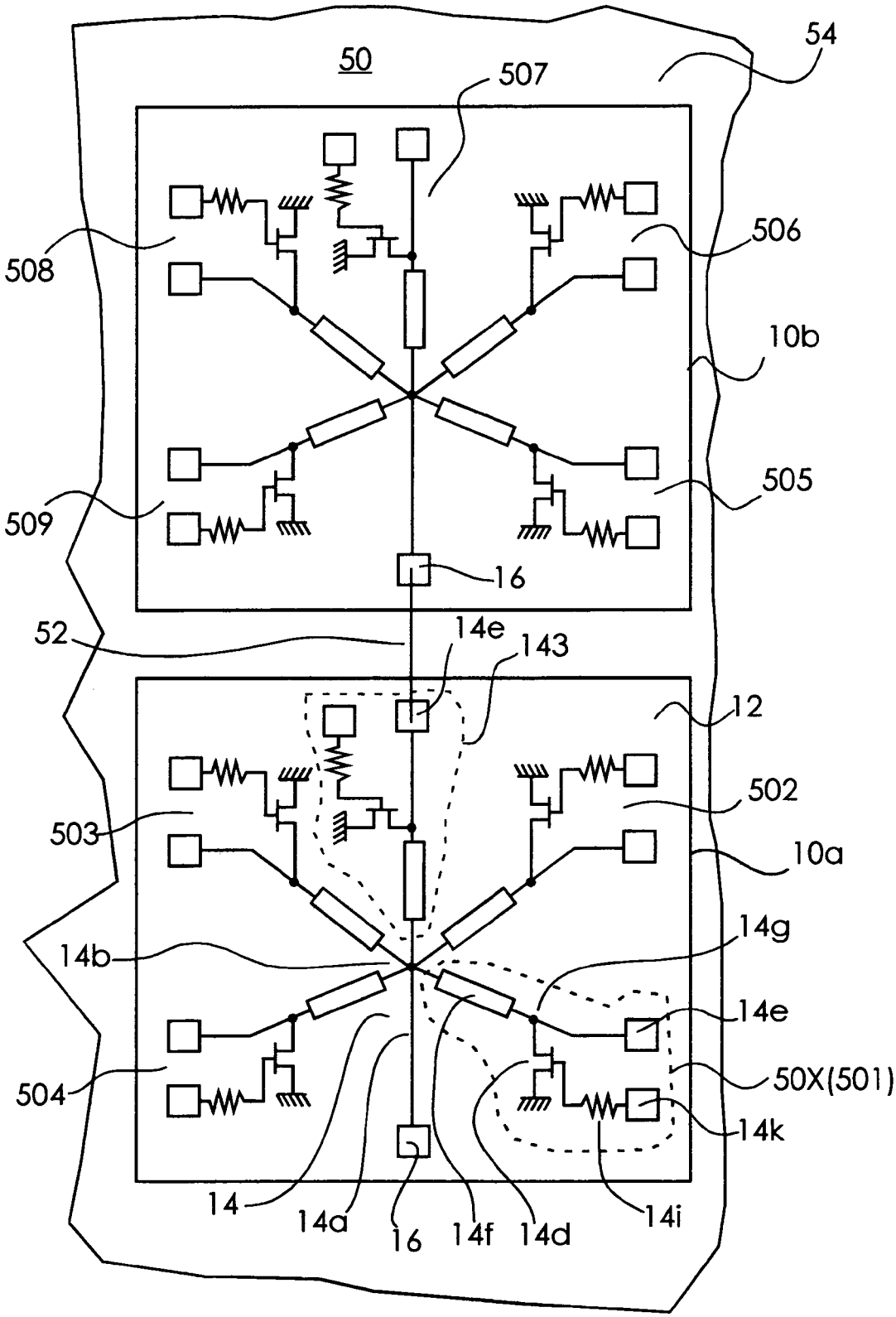
FIG. 13 is a circuit diagram showing a high frequency switch according to an embodiment of the present invention.

FIG. 13 is a circuit diagram showing a high frequency switch according to an embodiment of the present invention.

Referring to FIG. 13, the high frequency switch 50 is equivalent to one wherein the high frequency switch 10 having the five branch switches described in the first embodiment is connected two in series to configure a nine branch switch.

The high frequency switch 50 has a configuration wherein an output terminal 14*e* of a unit switch 143 of a high frequency switch 10*a* used as a first high frequency switch, and an input terminal 16 of a high frequency switch 10*b* used as a second high frequency switch are connected to each other by a bonding wire 52.

Thus, the nine branch switch equipped with the nine unit switches 50X (where X=1, 2, 3, . . . , 9) is configured, which is disposed on a dielectric substrate 54. The unit switches 50X are identical in configuration to the unit switches 14X.

The present nine-branch high frequency switch 50 is used to recognize a forward automobile, as, for example, a millimeter wave radar for automobile use and constitutes part of a system for performing automobile collision avoidance.

The system for carrying out automobile collision avoidance scans three directions one-lane assuming that the automobile is being driven along three lanes. Therefore, the millimeter wave radar for detecting the forward automobile needs to scan nine directions and requires a nine branch high frequency switch which switches an RF signal over to the nine directions.

The high frequency switches 10*a* and 10*b* that constitute the high frequency switch 50 are configured as MMICs and respectively have isolations of, for example, 30 dB between the respective unit switches 50X. Therefore, high resolution in the adjacent two directions can be ensured and variations in characteristic between the unit switches 50X are less reduced.

Since the high frequency switch 50 is provided only with the high frequency switches 10*a* and 10*b* and the bonding wires 52 for connecting the high frequency switches 10*a* and 10*b*, as parts, the number of parts can be reduced and variations in electrical characteristic between the unit switches 50X can be lessened.

As described above, the high frequency switch according to the present embodiment is equivalent to one wherein two each corresponding to the high frequency switch 10 having the five branch switches described in the first embodiment are selected and the output terminal 14*e* of the unit switch 143 of the high frequency switch 10*a* and the input terminal 16 of the high frequency switch 10*b* used as a second high frequency switch are connected by the bonding wire. Owing to such a configuration, the high frequency switch reduced in the number of parts and uniform in terms of the electrical characteristics of the switches for the respective branch lines can be configured while maintaining predetermined isolation between the adjacent unit switches 50X. This high frequency switch can be provided at low cost.

Incidentally, although the present embodiment has explained, as one example, the two series-connected high frequency switches, the number of the high frequency switches is not necessarily limited to two. Much more high frequency switches may be connected.

Modification 1

Figure 14:
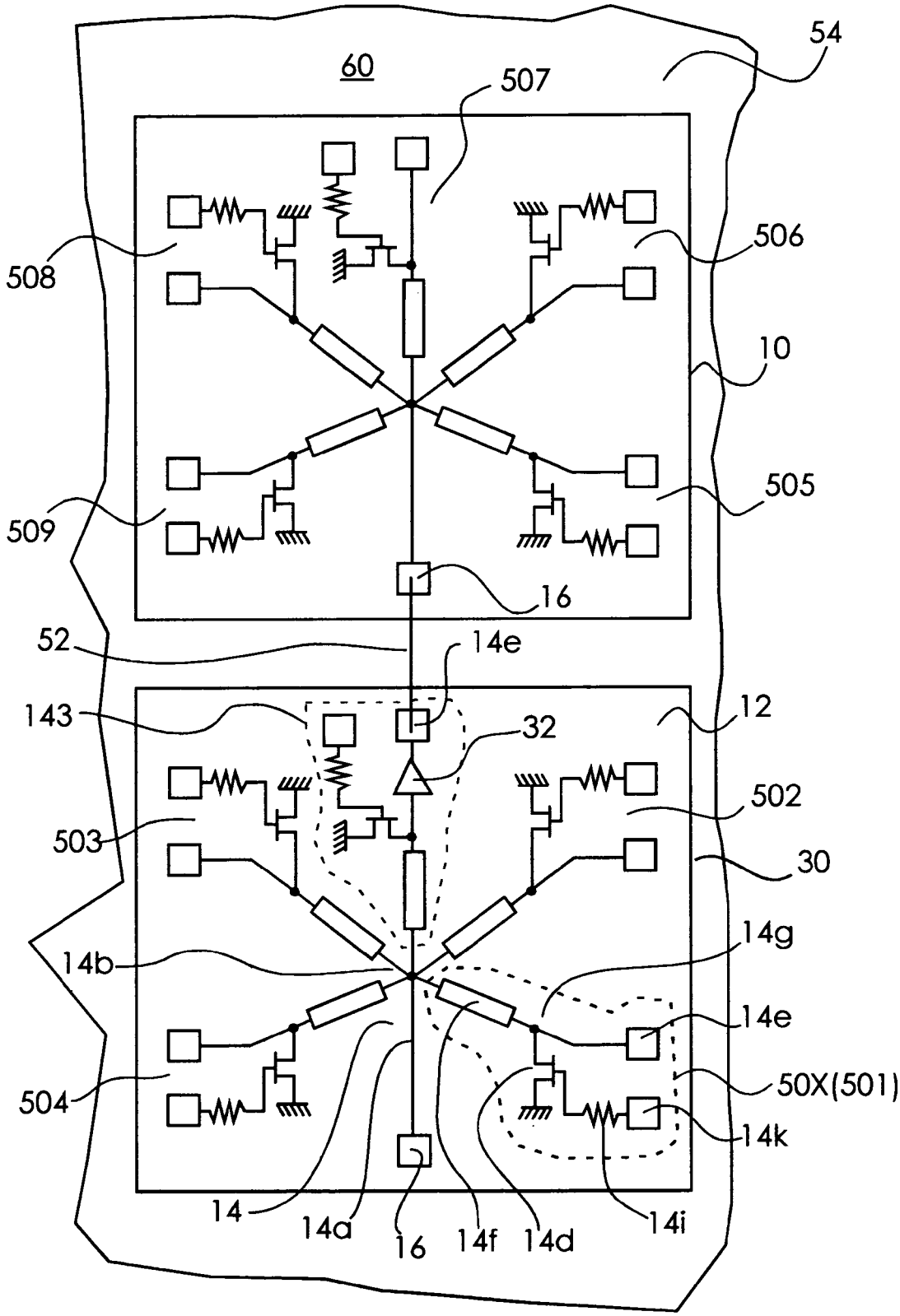
FIG. 14 is a circuit diagram showing a modification of the high frequency switch according to an embodiment of the present invention.

FIG. 14 is a circuit diagram showing a modification of the high frequency switch according to an embodiment of the present invention.

The high frequency switch 60 shown in FIG. 14 is equivalent to one wherein the high frequency switch 30 having the five branch switches described in the first embodiment is used as a first high frequency switch and the high frequency switch 10 having the five branch switches described in the first embodiment is used as a second high frequency switch.

That is, the high frequency switch 60 has a configuration wherein the output terminal 14*e* of the unit switch 143 of the high frequency switch 30 and the input terminal 16 of the high frequency switch 10 are connected by a bonding wire 52.

In the high frequency switch 60, an RF signal inputted to the input terminal 16 is reduced in signal output due to a passage loss. Therefore, when the RF signal is inputted from the output terminal 14*e* of the unit switch 143 to the input terminal 16 of the high frequency switch 30 in case of no amplifier 32, a difference occurs between each of outputs of unit switches 501, 502, 503 and 504 of the high frequency switch 30 and each of outputs of unit switches 505, 506, 507, 508 and 509 of the high frequency switch 10. In order to prevent it, the amplifier 32 temporarily amplifies the RF signal and thereby compensates for the passage loss, before the RF signal is outputted from the output terminal 14*e* of the unit switch 143 of the high frequency switch 30, and inputs the so-processed signal to the input terminal 16 of the high frequency switch 10.

Thus, the outputs of the RF signals of the respective unit switches 50X can be uniformized. By extension, a high frequency switch can be configured which is uniform in terms of electrical characteristics of the switches of the respective branch lines.

This high frequency switch can be provided at low cost.

Modification 2

Figure 15:
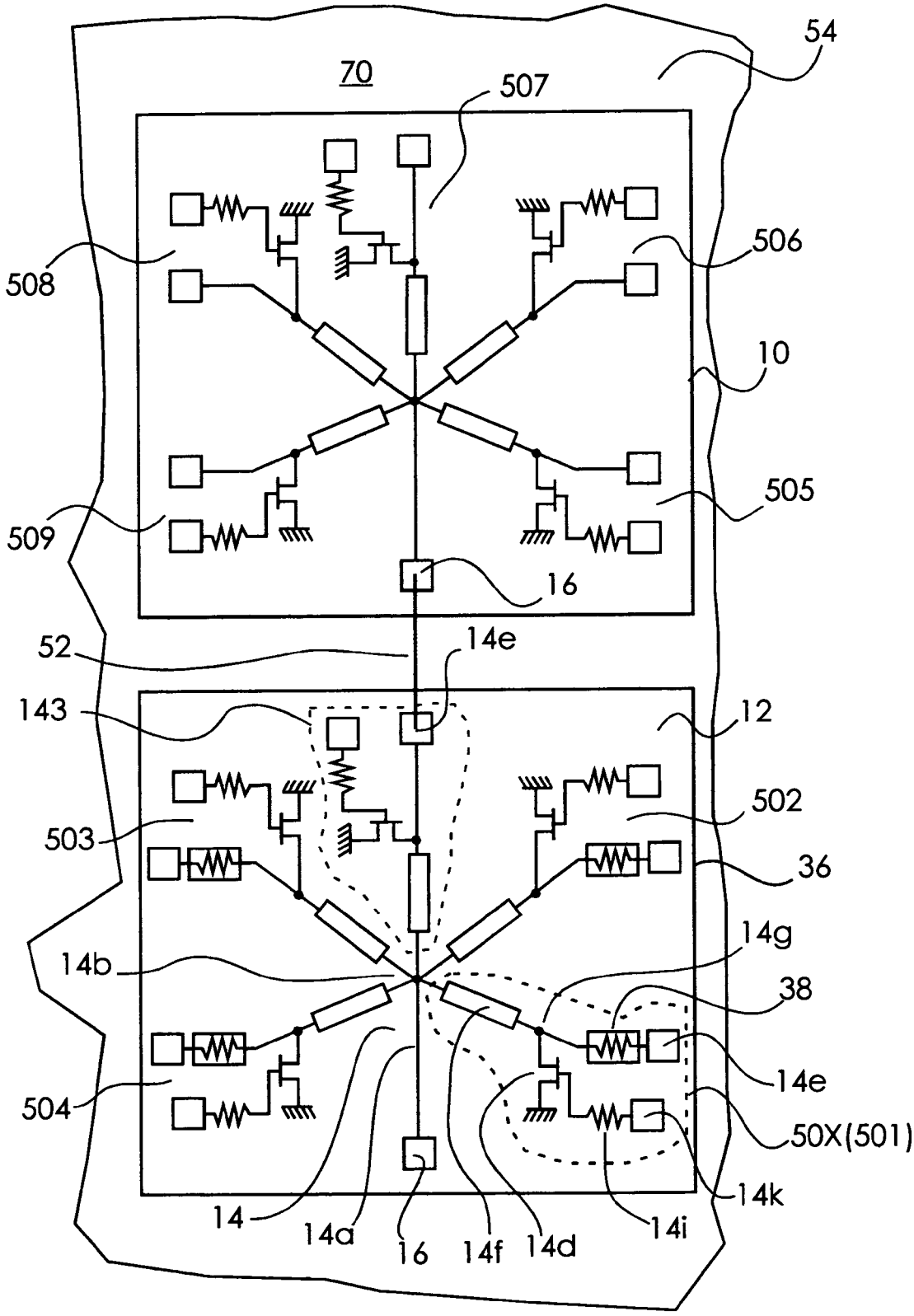
FIG. 15 is a circuit diagram showing a modification of the high frequency switch according to an embodiment of the present invention.

FIG. 15 is a circuit diagram showing a modification of the high frequency switch according to an embodiment of the present invention.

The high frequency switch 70 shown in FIG. 15 is equivalent to one wherein the high frequency switch 36 having the five branch switches described in the first embodiment is used as a first high frequency switch and the high frequency switch 10 having the five branch switches described in the first embodiment is used as a second high frequency switch.

That is, the high frequency switch 70 has a configuration wherein the output terminal 14*e* of the unit switch 143 of the high frequency switch 36 and the input terminal 16 of the high frequency switch 10 are connected to each other by a bonding wire 52.

In the high frequency switch 70, an RF signal inputted to the input terminal 16 is reduced in signal output due to a passage loss. Therefore, when the RF signal is inputted from the output terminal 14*e* of the unit switch 143 to the input terminal 16 of the high frequency switch 30 in case of no attenuators 38, a difference occurs between each of outputs of unit switches 501, 502, 503 and 504 of the high frequency switch 36 and each of outputs of unit switches 505, 506, 507, 508 and 509 of the high frequency switch 10. In order to prevent it, the attenuators 38 are respectively inserted immediately before the output terminals 14*e* of the unit switches 501, 502, 503 and 504, whereby the outputs of the unit switches 501, 502, 503 and 504 and the outputs of the unit switches 505, 506, 507, 508 and 509 can be uniformized.

Thus, the outputs of the RF signals of the respective unit switches 50X can be uniformized. By extension, a high frequency switch can be configured which is uniform in terms of electrical characteristics of the switches of the respective branch lines. This high frequency switch can be provided at low cost.

Modification 3

Figure 16:
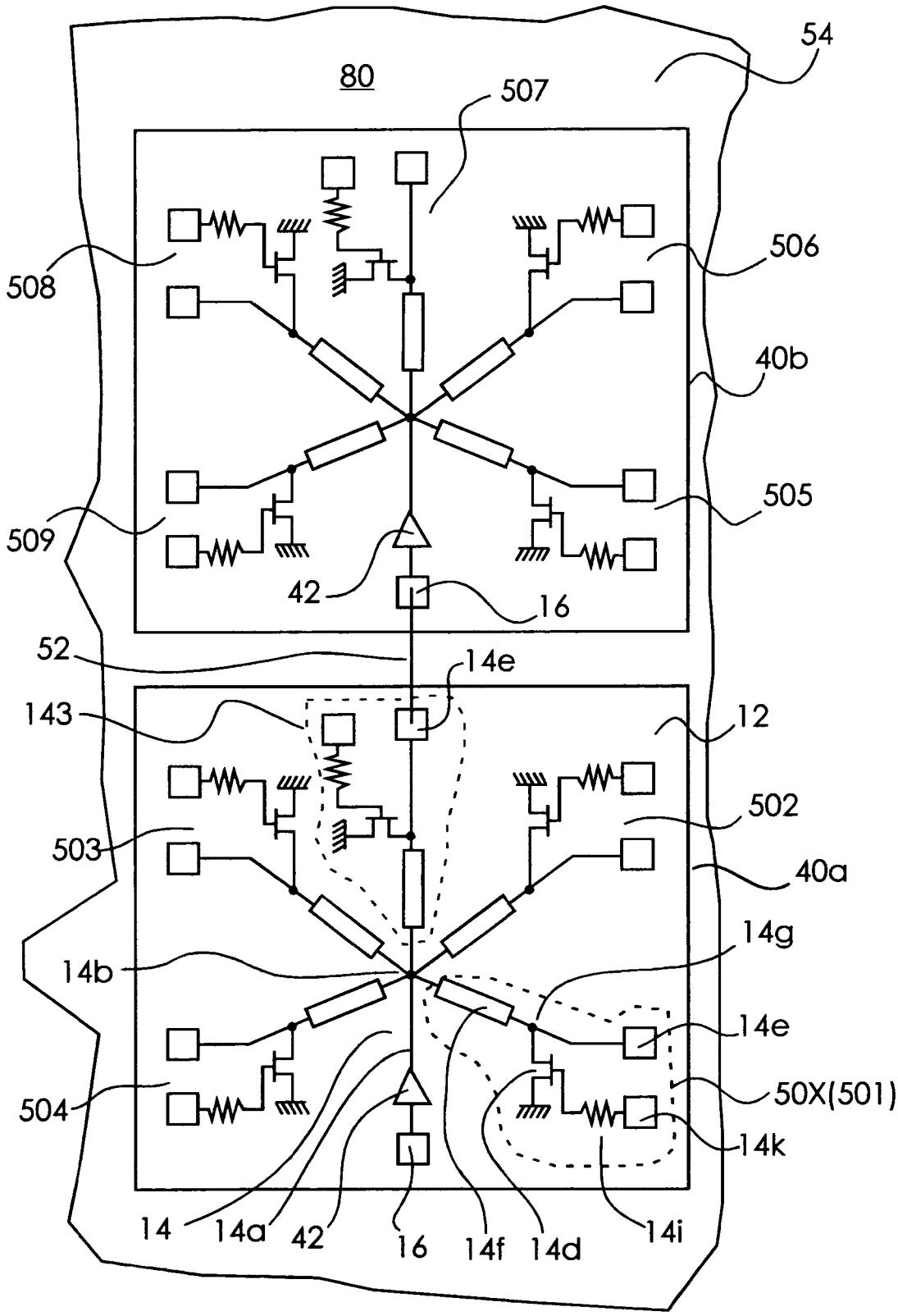
FIG. 16 is a circuit diagram showing a modification of the high frequency switch according to an embodiment of the present invention.

FIG. 16 is a circuit diagram showing a modification of the high frequency switch according to an embodiment of the present invention.

In FIG. 16, the high frequency switch 80 is equivalent to one wherein the high frequency switch 40 having the five branch switches described in the first embodiment is connected two in series so as to be configured as a nine branch switch.

The high frequency switch 80 has a configuration wherein the output terminal 14*e* of the unit switch 143 of the high frequency switch 40*a* used as a first high frequency switch, and the input terminal 16 of the high frequency switch 40*b* used as a second high frequency switch are connected to each other by a bonding wire 52.

Since each of the high frequency switches 40*a* and 40*b* has a passage loss, an RF signal inputted to the input terminal 16 of the high frequency switch 40*a* is reduced in signal output due to the passage loss when it is inputted from the output terminal 14*e* of the unit switch 143 to the input terminal 16 of the high frequency switch 40*b* in case of no amplifiers 42. Therefore, a difference occurs between each of outputs of unit switches 501, 502, 503 and 504 of the high frequency switch 30 and each of outputs of unit switches 505, 506, 507, 508 and 509 of the high frequency switch 10. In order to prevent it, the amplifiers 42 are respectively provided immediately following the input terminals 16 of the high frequency switches 40*a* and 40*b*. Each of the amplifiers 42 effects beforehand compensation corresponding to the passage loss on the input RF signal and transmits the so-processed signal to each of the unit switches 50X.

Thus, the outputs of the RF signals of the unit switches 50X can be uniformized. By extension, a high frequency switch can be configured which is uniform in terms of electrical characteristics of the switches of the respective branch lines. This high frequency switch can be offered at low cost.

Although the second embodiment has explained, as an example, the case in which some of the high frequency switches described in the first embodiment are combined together, other high frequency switches described in the first embodiment may be utilized in combination.

As described above, the high frequency switch according to the present invention is suitable for a high frequency switch used for switching of an RF signal employed in each of a radar and a communication device operated in a millimeter wave band.

While the presently preferred embodiments of the present invention have been shown and described. It is to be understood these disclosures are for the purpose of illustration and that various changes and modifications may be made without departing from the scope of the invention as set forth in the appended claims.

What is claimed is:

1. A high frequency switch comprising:

a first semiconductor substrate;

a first signal line provided on the first semiconductor substrate and having a first main line, and first branch lines that branch into four or more from the first main line via a first branch point and first transmission lines each having a length of a ¼ wavelength of a signal propagated over the first branch lines, said each first transmission line being contained in part of said each first branch line; and first switching elements each of which is shunt-connected between the first branch line on the end side of the first transmission line as viewed from the first branch point of the first signal line, and a ground end and electrically connects or shuts off the first branch line and the ground end in accordance with a control signal;

wherein connecting points of the first switching elements at the two first branch lines are spaced such that isolation corresponding to the frequency of the signal reaches between 25 dB and 35 dB at the ends of the two first branch lines, and the first switching element to which a control signal is applied, is provided between the two first branch lines, and first resistors and first capacitors connected in series are further provided and shunt-connected between first control signal lines connected to control electrodes of the first switching elements and the ground end.

2. The high frequency switch according to claim 1, further comprising an amplifier provided at an end of one of the branch signal lines of the first signal line.

3. The high frequency switch according to claim 1 wherein the number of the first branch lines is five.

4. The high frequency switch according to claim 1, further comprising an amplifier provided at the first main line of the first signal line.

5. A high frequency switch comprising:

a first semiconductor substrate;

a first signal line provided on the first semiconductor substrate and having a first main line, and first branch lines that branch into four or more from the first main line via a first branch point and first transmission lines each having a length of a ¼ wavelength of a signal propagated over the first branch lines, said each first transmission line being contained in part of said each first branch line; and first switching elements each of which is shunt-connected between the first branch line on the end side of the first transmission line as viewed from the first branch point of the first signal line, and a ground end and electrically connects or shuts off the first branch line and the ground end in accordance with a control signal, wherein connecting points of the first switching elements at the two first branch lines are spaced such that isolation corresponding to the frequency of the signal reaches between 25 dB and 35 dB at the ends of the two first branch lines, and the first switching element to which a control signal is applied, is provided between the two first branch lines, and capacitors are further provided and shunt-connected between first control signal lines connected to control electrodes of the first switching elements and the ground end.

6. A high frequency switch comprising:

a first semiconductor substrate;

a first signal line provided on the first semiconductor substrate and having a first main line, and first branch lines that branch into four or more from the first main line via a first branch point and first transmission lines each having a length of a ¼ wavelength of a signal propagated over the first branch lines, said each first transmission line being contained in part of said each first branch line; and first switching elements each of which is shunt-connected between the first branch line on the end side of the first transmission line as viewed from the first branch point of the first signal line, and a ground end and electrically connects or shuts off the first branch line and the ground end in accordance with a control signal, wherein connecting points of the first switching elements at the two first branch lines are spaced such that isolation corresponding to the frequency of the signal reaches between 25 dB and 35 dB at the ends of the two first branch lines, the high frequency switch further comprising:

a second semiconductor substrate;

a second signal line provided on the second semiconductor substrate and having a second main line, and second branch lines that branch into four or more from the second main line via a second branch point and second transmission lines each having a length of a ¼ wavelength of a signal propagated over the second branch lines, said each second transmission line being contained in part of said each second branch line; and second switching elements each of which is shunt-connected between the second branch line on the end side of the second transmission line as viewed from the second branch point of the second signal line, and a ground end and electrically connects or shuts off the second branch line and the ground end in accordance with a control signal;

wherein connecting points of the second switching elements at the two second branch lines are spaced such that isolation corresponding to the frequency of the signal reaches between 25 dB and 35 dB at the ends of the two second branch lines; and a wire connecting one of ends of first branch lines and the second main line to each other.

7. The high frequency switch according to claim 6, further comprising an attenuator provided at the end of first branch lines of the first signal line.

8. The high frequency switch according to claim 6, further comprising an amplifier provided at the end of the branch signal line of the first signal line connected with the wire.

9. The high frequency switch according to claim 8, further comprising an amplifier provided at the first main line of the first signal line.

* * * * *